US006398435B1

(12) United States Patent
Kozakai et al.

(10) Patent No.: US 6,398,435 B1
(45) Date of Patent: Jun. 4, 2002

(54) MARKING PRESS DEVICE FOR PRODUCING RAISED SYMBOLS WITH OR WITHOUT COLORING

(75) Inventors: Masahiro Kozakai; Mitsuo Yokozawa, both of Nagano (JP)

(73) Assignee: Sankyo Seiki Mfg. Co., Ltd., Nagano-ken (JP)

( * ) Notice: Subject to any disclaimer, the term of this patent is extended or adjusted under 35 U.S.C. 154(b) by 0 days.

(21) Appl. No.: 09/596,995

(22) Filed: Jun. 20, 2000

(30) Foreign Application Priority Data

Jun. 22, 1999 (JP) ..... 11-175924
Jun. 23, 1999 (JP) ..... 11-176340
Jul. 14, 1999 (JP) ..... 11-200400

(51) Int. Cl.[7] ..... B41J 1/24; B41J 1/30; B41J 3/32; B41J 35/20; B41F 19/08

(52) U.S. Cl. ..... 400/144.2; 400/109.1; 400/211; 400/212; 400/521; 400/129; 400/132; 400/134; 101/18; 101/93.18

(58) Field of Search ..... 101/18, 32, 93.18, 101/93.19, 93.17, 9, 10, 27; 400/144.2, 211, 521, 212, 109, 109.1, 129, 134, 132, 134.1, 134.2, 134.3

(56) References Cited

U.S. PATENT DOCUMENTS 3,620,343 A * 11/1971 Deutsch ..... 400/134
4,930,911 A * 6/1990 Sampson et al. ..... 400/28
6,016,745 A * 1/2000 Bartel et al. ..... 101/18

FOREIGN PATENT DOCUMENTS

JP 56-123236 9/1981
JP 63-114655 A * 5/1988
JP 10-315596 12/1998
JP 10-315597 12/1998
JP 10-315597 A * 12/1998

* cited by examiner

*Primary Examiner*—Daniel J. Colilla
(74) *Attorney, Agent, or Firm*—Reed Smith LLP

(57) ABSTRACT

A marking press device having a pair of type arms that face each other to interpose a workpiece to be marked therebetween, a type fixed on each of said type arms for making a mark thereof, a circular type assembling member around which a plurality of said type arms are attached radially, a device for rotatably supporting said type assembling member around a rotary shaft and for pressing a selected type from said type assembling member onto said workpiece, a driver for rotating said type assembling member, a ribbon guiding mechanism that guides an inked ribbon for coloring marked characters, a ribbon supplying spool for supplying said inked ribbon, a ribbon winding spool for winding said inked ribbon, a ribbon frame to which said ribbon guiding mechanism, said ribbon supplying spool and said ribbon winding spool are mounted, and ribbon frame turning device for rotatably supporting said ribbon frame and turning said ribbon frame to a horizontal position above said type arms when said inked ribbon is replaced.

18 Claims, 11 Drawing Sheets

Braille dot pattern for "Te", a *katakana*

MARKING PRESS DEVICE FOR PRODUCING RAISED SYMBOLS WITH OR WITHOUT COLORING

BACKGROUND OF THE INVENTION

The present invention relates to a marking press device.

Marking and pressing of characters, symbols, numbers or figures includes a technique of so-called indenting and another technique of so-called embossing. Indenting produces indented marks that correspond to raised types by placing and pressing a workpiece between a pressing member having a raised type at a front end and a flat pressing member positioned opposite the pressing member. Embossing produces embossed marks that correspond to raised types by placing and pressing a workpiece between a pressing member having a raised type at a front end thereof and an oppositely placed recessed marking member.

A general embossing involves a topping, i.e., a coloring of the front surface of the characters. Also, a general indenting involves a coloring of grooved bottoms of the indented characters with ink.

An inked ribbon may be used for coloring such indented characters. In such a marking press device, a workpiece and a inked ribbon are together placed and pressed between a pressing member having a raised type and a flat pressing member to mark an indented character and at the same time to color the character groove. The inked ribbon is wound around a supply reel (hereinafter, denoted to as a spool) in advance. The inked ribbon is guided to the place between the workpiece such as a card and the pressing member and the used portion of the ribbon is constantly guided to a winding spool.

However, in the marking press device in which the inked ribbon is supplied and wound up in the above manner, both spools for supplying and winding may be located deep inside or at a narrow space in the device. Thus, it has been difficult to replace the spools. Also, when the spools are replaced, the inked ribbon needs to run through a roller, guide, etc. In this case, the ribbon may be set in a wrong route or inside out, causing problems in issuing cards.

Also, in the marking press device in which pressing (embossing or indenting) and coloring are performed simultaneously, an inked ribbon is always interposed between a workpiece, such as a card, and a type. Therefore, it is impossible to perform only pressing without coloring, or even if possible, it mostly requires considerably troublesome work of, for example, detaching (dismounting) the inked ribbon. For this reason, it has been difficult to employ such a marking press device configured as above for general uses.

Furthermore, when forming characters, symbols, etc. on a workpiece such as a plastic card, a process called embossing is performed to emboss characters, etc. as in a raised form on a front surface of the workpiece. The marking press device that performs embossing has type assemblies in the same number as that of characters, symbols, etc. to be marked.

In some cases, Braille code characters formed by combining raised dots in predetermined patterns are produced on a workpiece by such a marking press device. The type composed of combined dots is pressed onto a workpiece to raise dots in a predetermined pattern. However, the marking press device that produces Braille code characters in the above manner is required to equip the same number of types as the number of Braille dot patterns, in the same manner as a marking press device for characters. For this reason, even if it is a relatively simplified marking press device, a considerable number of types need to be prepared, increasing the number of components. As a consequence, the weight of the marking press device itself has been very heavy.

Specifically, Braille characters are represented by raised dots combined in predetermined patterns. Within the six-dot cell, the dot positions are 1–2–3 downward on the left and 4–5–6 downward on the right. The combinations are made (2*6)=64 patterns; one pattern with no dots is taken from the patterns, making 63 final combinations. Thus, the marking press device that produces Braille code characters is required to equip a considerable number of types.

A high speed marking press device, in which various kinds of types such as hiragana, katakana, Braille code characters, etc. are arranged around a plurality of rotary wheels to enable pressings of various kinds of characters, symbols, etc., has been developed. In such a large device, the number of necessary types is considerably large.

OBJECTS AND SUMMARY OF THE INVENTION

It therefore is an object of the present invention to provide a marking press device that provides for convenient and simplified changing of ribbon supplying spool and ribbon winding spool.

Another object of the invention is to provide a marking press device that can perform both pressings with and without coloring and also allows switching these two kinds of pressing techniques easily.

A further object of the present invention is to provide a marking press device in which the number of types necessary for producing Braille code characters is reduced in order to make a simple configuration.

To achieve the above objects, the marking press device of the present invention includes a ribbon frame that can be turned at least to its horizontal position. The ribbon winding spool and the ribbon supplying spool are attached on the ribbon frame and can be replaced simply and easily. Rollers and guides are moved from narrow spaces so that a new ribbon can be set simply and easily.

In accordance with the present invention, the ribbon frame is turned to withdraw the ribbon, making it possible to press types without coloring. The ribbon is withdrawn away from the front surface of the workpiece, and thus the movement of the workpiece is hindered.

Also in accordance with the present invention, the ribbon frame is turned by hand for the ribbon replacement. Therefore, the power to turn the ribbon frame is not required, making the construction simple.

Further, according to the marking press device of the present invention, for indenting, the ribbon frame is turned to the position at which the ribbon is interposed between the type and the workpiece. Therefore, it is possible to perform the embossing process without coloring and the indenting process with coloring. In addition, the process can easily be selected and simply switched only by turning the ribbon frame.

Still further, according to the marking press device of the present invention, the flange attaching lever is turned to eliminate ribbon slack. Thus, the present invention provides a simple configuration with necessary controls.

As understood from the above description, the ribbon frame is capable of turning between the stand-by position and the position for coloring; therefore, the coloring can be performed on the indented character or embossed character at the same time as making a mark if necessary.

Moreover, the ribbon frame is turned by a driving means such as a solenoid. Therefore, the ribbon frame is easily switched between the positions, thus providing convenience in operation. Since the inked ribbon can be withdrawn to the position, where it does not make contact with the workpiece, when the coloring is unnecessary, the workpiece such as a card cannot be hindered from being transported.

Moreover, in the marking press device of the present invention, when the ribbon frame is turned, the ribbon guiding route can be interposed between the back surface of the workpiece and the type. Therefore, while a mark is pressed onto the workpiece back surface, the back indent with coloring the groove of the mark can be performed.

Still further, according to the marking press device of the present invention, the workpiece can be positioned inside the ribbon guiding route for the back indent. In this case, the inked ribbon never hinders the movement of the workpiece, and therefore, the workpiece can move in a wide range and marking and coloring are given to a large area of the surface of the workpiece.

Additionally, according to the marking press device of the present invention, the ribbon frame is turned by the solenoid. Thus, the configuration can be made simple, and at the same time, the position of the ribbon frame when turned can easily be determined.

For indenting, the ribbon arm is moved following the movement of the ribbon frame to lower the ribbon guiding route. Therefore, the ribbon can be located at a predetermined position between the workpiece and the type for indenting, and withdrawn to a position away from the workpiece for stand-by. Also, since the ribbon arms are swung by using the driving mechanism of cam, the configuration can be simple with reduced number of components and with high reliability. Further, the swing of the ribbon arms are controlled to appropriately change the height of the ribbon guiding route, making it possible to properly select the front indent or the back indent.

Also, in accordance with the present invention, the ribbon arm fulcrums are located at the positions with which the length of the ribbon route varies only slightly as the ribbon arms oscillate up and down. Therefore, when the ribbon arms oscillates up and down, little slack will be generated in the ribbon; even the minimum slack is eliminated by the spring of the ribbon supplying spool. Also, because of the ribbon tension, less torque is exerted on the ribbon arms. Thus, the energy required for moving the ribbon arms can be greatly reduced.

Further, in accordance with the present invention, a stopper is provided for controlling the position of the ribbon frame. Therefore, the turning range of the ribbon frame from the stand-by position to the indent position is controlled and the ribbon frame stops at a predetermined position. For this reason, an accurate position of the ribbon can be determined, and therefore, poor coloring which is normally caused by ribbon displacement is unlikely to occur.

When the ribbon frame is turned by hand, the control member of the stopper is not actuated. Thus, the ribbon frame can be turned over a wide range.

As understood from the above description, the marking press device of the present invention has paid attention to the possibility of forming Braille dot patterns by combining six dots that are positioned in a predetermined pattern, and all kinds of Braille code characters can be produced with the six kinds of cells, each of which respectively has a dot in an assigned position thereon. Therefore, the marking press device for producing Braille code characters can be simply configured.

Furthermore, six recesses are formed on a recessed-dot cell, which makes a pair with a the raised-dot cell, to correspond to the six dots for embossing Braille dot patterns so that the already formed raised dot is protected when pressing and embossing are performed for forming successive dots for a character. In addition, the recesses serve as a guide for dots. Therefore, the workpiece can be precisely positioned, a Braille dot pattern can be perfectly formed as if it were formed by one time strike.

Braiile character type sets are provided in the type assembling member that is normally used for embossing normal characters. Therefore, Braille dot patterns as well as normal characters, symbols, etc. can be produced.

Further, all kinds of Braille dot patterns can be formed on a plastic card as a workpiece.

Finally, in accordance with the present invention, raised-dot cells used for embossing frequently used Braille dot patterns and a recessed-dot cell having six recesses are made in a plurality of pairs and retained in the device in addition to the six primary pairs. Therefore, a one-time operation can save multiple-time operations which a raised-dot cell having only a single raised dot needs to perform to produce a complete Braille dot pattern for a character.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF CERTAIN PREFERRED EMBODIMENTS

Figure 1:
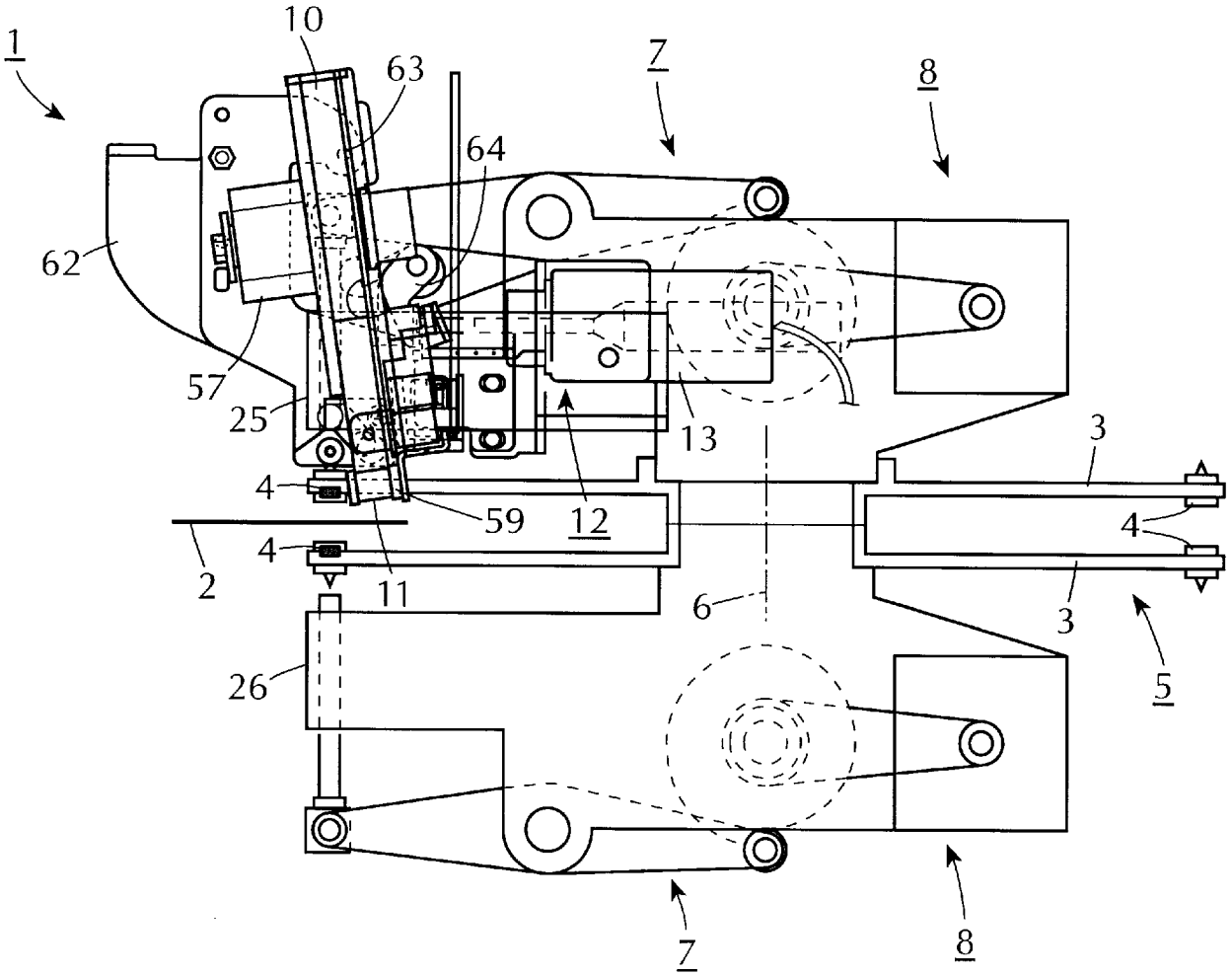
FIG. 1 is a side view of a marking press device of an embodiment of the present invention, showing a ribbon frame at a stand-by position.

FIGS. 1–9 show an embodiment of a marking press device of the present invention. A marking press device 1 presses characters and the like onto a workpiece 2 such as a credit card (simply, "card" herein). As shown in FIG. 1, the marking press device comprises a pair of type arms 3, 3 that face each other to interpose a workpiece 2 therebetween, a type 4 that is fixed on each type arm 3 and makes a mark thereof, a circular type assembling member 5 to which a plurality of type arms 3 are attached radially, a pressing means 7 that supports the type assembling member 5 rotatable around a rotary shaft 6 and presses a selected type 4 from the type assembling member 5 onto the workpiece 2, and a driving means 8 that rotates the type assembling member 5. Note that the characters and the like here indicate hiragana, katakana, Chinese characters, alphabets, symbols, or drawings.

The marking press device 1 also comprises a ribbon guiding mechanism 9, a ribbon frame 10 to which the ribbon guiding mechanism 9 is mounted, and a ribbon frame driving mechanism 12. The ribbon guiding mechanism 9 guides an inked ribbon 11 for coloring characters marked on the workpiece 2. The ribbon frame turning mechanism 12 rotatably supports the ribbon frame 10, and turns the ribbon frame 10 to a position, at which the inked ribbon 11 is withdrawn from a typing position of the workpiece 2 when the inked ribbon 11 is at stand-by, and to a position at which the inked ribbon 11 is interposed between the type 4 and the workpiece 2. Note that, although a plastic card is used as the workpiece 2 to be marked in the embodiment described below, it is only one of the examples of the workpiece 2.

Figure 4:
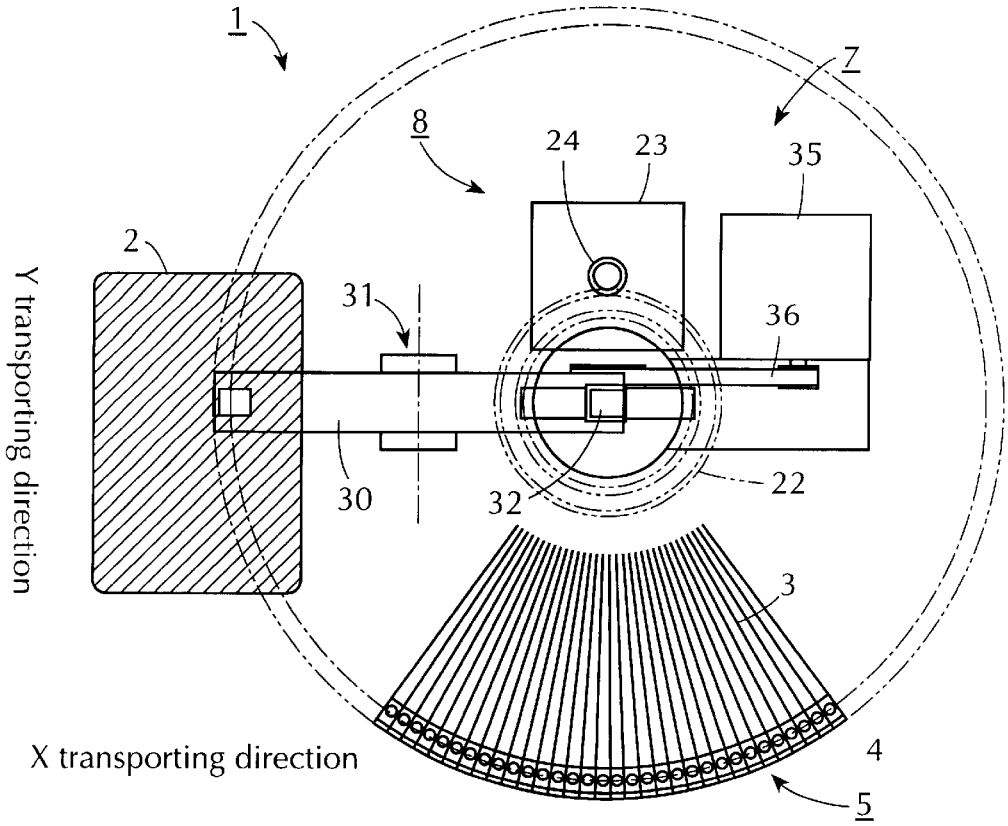
FIG. 4 is a plan view of a basic structure of the marking press device.
Figure 5:
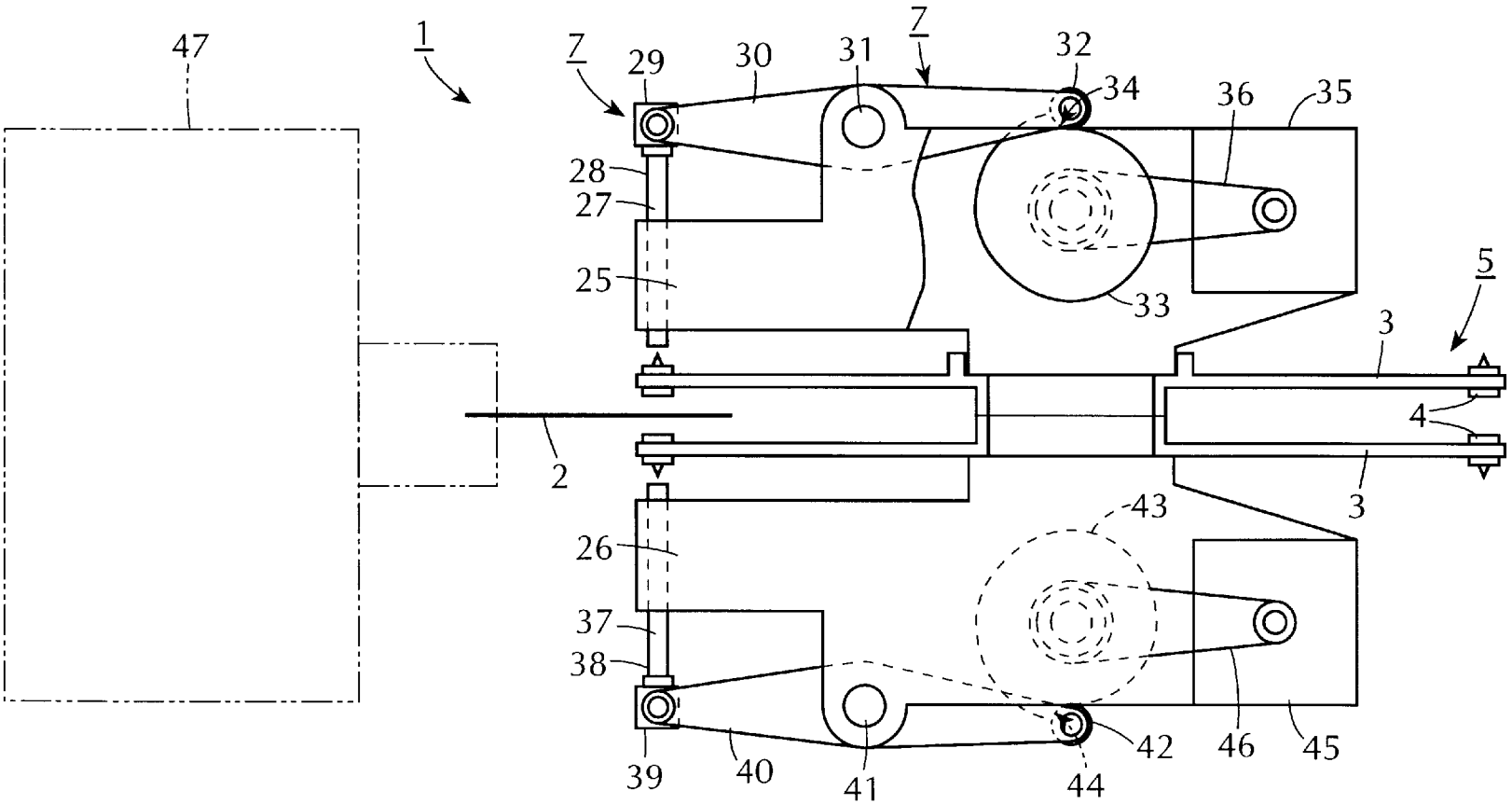
FIG. 5 is a side view of the basic structure of the marking press device.

First, a basic structure of the marking press device 1 is described using FIGS. 4 and 5. The marking press device 1 mainly comprises type arms 3, types 4, type assembling member 5, and pressing means 7. Various kinds of types 4 are prepared in number necessary to produce embossed characters or indented characters. Each of the types 4 is provided on the tip end of each of the type arms 3 and arranged around a circumference. The type 4 consists of recessed and raised (female and male) types respectively provided at top and bottom, making a pair. In this embodiment, a flat type and a raised type are respectively arranged at top and bottom, vertically symmetric positions, as shown in FIG. 5.

The type arms 3 are arranged around the rotary shaft 6, as shown in FIG. 4, to construct the rotatable type assembling member 5. The type arms 3 are elastic enough to bend to some extent with a given force and to return to an original shape at a removal of the force. When receiving the pressing force in the perpendicular direction in the figure, the type arm 3 presses the type 4 onto the workpiece 2 to make a mark. A type arm gear 22 is provided around the rotary shaft 6. The type arm gear 22 is meshed with a motor gear 24 of the type arm driving motor 23 to turn the type assembling member 5 bit by bit so that a target type 4 can be selected.

To press such types 4 onto the workpiece 2 from top and bottom, a pressing means 7 comprised of a type pressing shaft 27, a swing arm 30, etc. is provided. The pressing means 7 is provided at upper frame 25 and lower frame 26, vertically symmetric positions. Therefore, only the pressing means 7 located on the upper side will be described hereinafter.

First, the type pressing shaft 27 is positioned right above the place in the upper frame 25 where the selected type 4 is pressed on the workpiece 2. The shaft 27 is also capable of sliding in the perpendicular direction in the figure. A type pressing shaft returning spring 28 is provided around the type pressing shaft 27 and energized to return the type pressing shaft 27. A pressing block 29 provided at a head portion of the type pressing shaft 27 rotatably connects the type pressing shaft 27 and the swing arm 30.

The swing arm 30 pushes down the type pressing shaft 27 with a lever effect and is capable of swinging around a fulcrum 31 on the upper frame 25 as shown in the figures. On the other end of the swing arm 30, a rotatable cam follower 32 that follows the movement of the cam 33 is provided.

The cam 33 is a spiral rotary body, in which the diameter thereof gradually increases, and swings the swing arm 30 by oscillating the cam follower 32 up and down together with the rotation of the cam 33. A step 34, on which the cam follower 32 never runs, is provided between a larger diameter portion and a smaller diameter portion of the cam 33. The step 34 is kept in contact with the cam follower 32 to keep the type pressing shaft 27 withdrawn to a predetermined position. The cam 33 is connected via a belt 36 with an upper cam driving motor 35 that rotates in right and reverse directions.

The construction of the pressing means 7 arranged on the upper side is described as above. On the other hand, the construction of the same arranged on the lower side is symmetric about the vertical centerline with the upper configuration. The same components as those on the upper side, i.e., type pressing shaft 37, type pressing shaft returning spring 38, pressing block 39, swing arm 40, fulcrum 41, cam follower 42, cam 43, step 44, lower cam driving motor 45, and belt 46, are arranged at symmetric positions.

The workpiece 2 such as a card is transported to a predetermined position by a card transporting mechanism 47 that has card stacker, card hopper, card retaining mechanism, etc. With the transporting mechanism 47, it is possible to move the workpiece 2 forward, backward, upward, and downward in a plane. For convenience, the longitudinal direction of the card is denoted to as a Y direction of the workpiece and the direction orthogonal to the Y transporting direction as an X transporting direction of the workpiece.

Note that, when the marking press device 1 produces indented characters, there are two coloring techniques involved: a front indent with which the inked ribbon 11 is placed between the workpiece 2 and the upper type 4 to color the front surface of the workpiece 2; a back indent with which the back surface of the workpiece 2 is colored. This embodiment is configured such that both techniques, front indent and back indent, can be performed. In other words, the position of the ribbon guiding route 14 can be changed. Only when coloring is necessary, coloring is performed while the device produces indented characters. On the other hand, when coloring is not necessary, the ribbon guiding route 14 moves to a stand-by position. Note that the front surface of the workpiece (card) 2 is the surface to which types are embossed.

For the above functions, the ribbon frame 10 is arranged so it can turn and be moved by a solenoid 13 as a driving means in the marking press device 1. Next, the ribbon frame 10 and ribbon frame turning mechanism 12 will be described.

Figure 7:
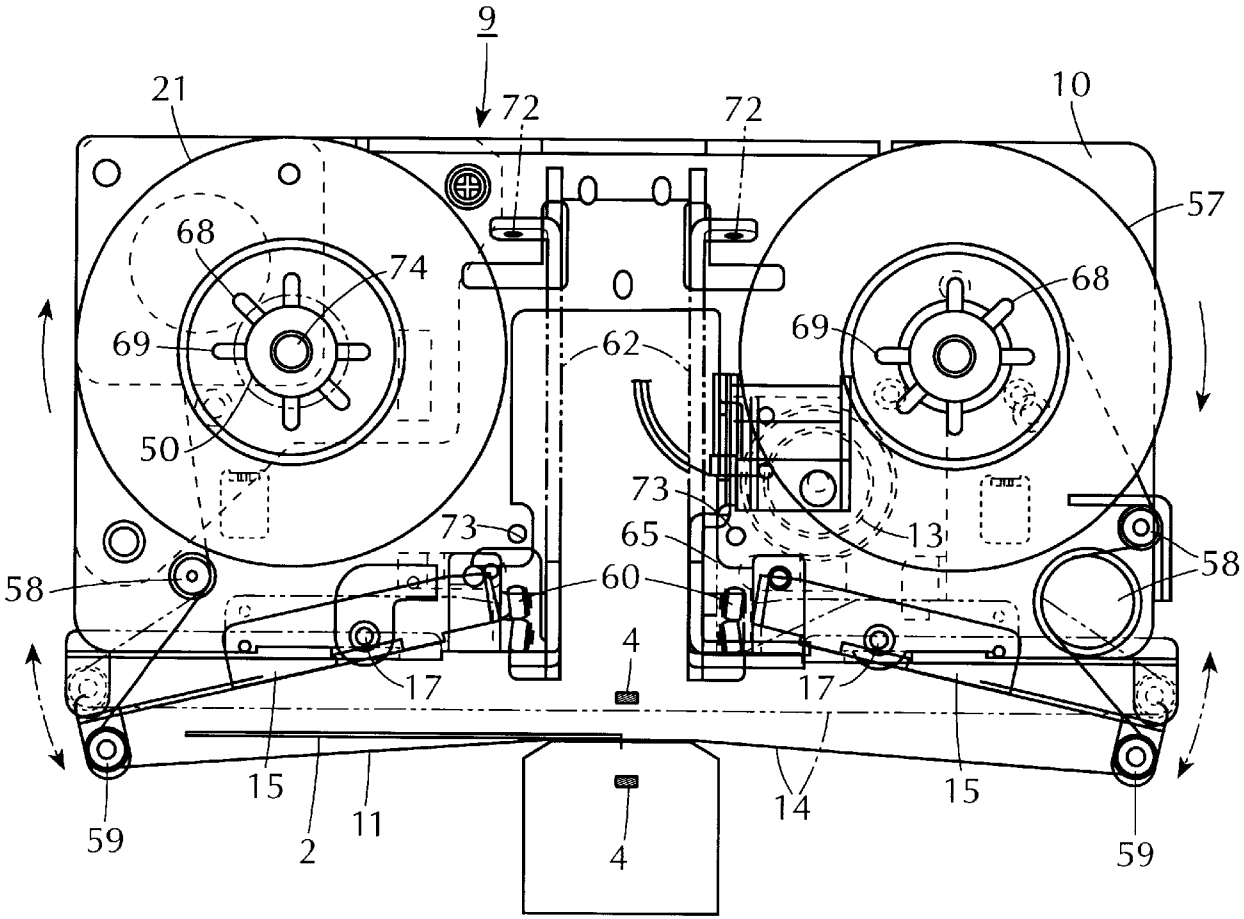
FIG. 7 is a front view of the ribbon frame having a ribbon guiding mechanism.

The ribbon frame 10 comprises a ribbon supplying spool 57, a ribbon winding spool 21, and a ribbon guiding mechanism 9 as shown in FIG. 7. This is configured so as to supply the inked ribbon 11 when producing indented characters. The ribbon supplying spool 57 and the ribbon winding spool 21 are rotatably attached to the right and left sides of the ribbon frame 10, and can be detached along the center axis for replacement.

Figure 9:
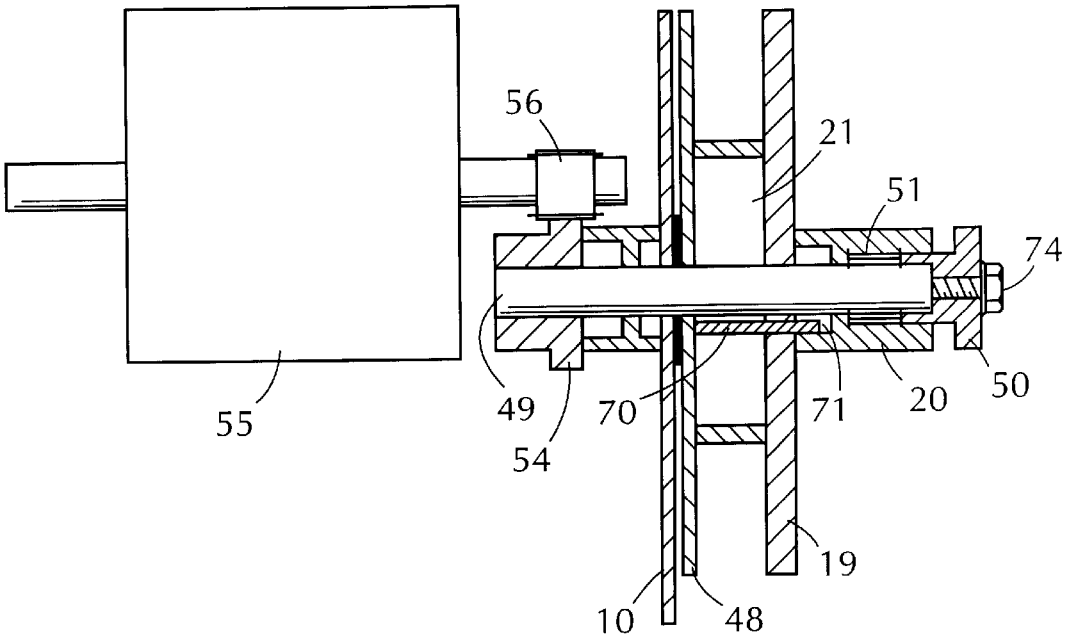
FIG. 9 is a vertical cross-sectional view when a ribbon winding spool is driven.

The ribbon winding spool 21 has a flange 48 and a holding flange (ribbon winding flange) 19 as shown in FIG. 9. At rotation, the ribbon winding spool 21 winds up the used inked ribbon 11. The ribbon winding spool 21 is mounted on a shaft 49 and pressed by a flange mounting lever 20 (hereinafter, simply denoted to as lever 20) to rotate together with the shaft 49. The shaft 49 is supported by the ribbon frame 10 and equipped with a fixed spool boss 70. The ribbon winding spool 21 also has a recessed-protrusion 71, that is fitted to the spool boss 70 to transmit the rotation, in an inner diameter portion as shown in FIG. 9.

A pressing boss 50 is mounted to a front end of the shaft 49 with, for example, a screw 74 as shown in the figure in this embodiment. The lever 20 is positioned between the pressing boss 50 and the ribbon winding flange 19 such that it is capable of sliding in the axial direction and rotating around the shaft 49. Further, a pressing spring 51 is interposed to energize the lever 20 toward the flange 19.

Around the lever 20, a protrusion 68 is formed in two places 180 degree apart as shown in FIG. 7. A groove 69 is cut in two places in the inner circumference of the holding flange 19 and ribbon winding spool 21 to let the protrusion 68 pass through. The inner diameter of the hollow ribbon winding spool 21 is slightly wider than the outer diameters of the pressing boss 50 and lever 20. Therefore, when the ribbon winding spool 21 is mounted in the ribbon frame 10, the protrusion 68 is aligned with and fitted into the groove 69; then, it is shifted to the flange mounting position. Then, the lever 20 is pulled up toward the front and turned to the point where the protrusion 68 and groove 69 are no longer aligned. At this time, as the hand is released from the lever 20, the protrusion 68 engages with the portion other than the groove 69 and pushes the ribbon winding spool 21. Therefore, the ribbon winding spool 21 will not come off during the rotation.

The protrusion 68 remains engaged with the groove 69 unless the lever 20 is pulled up. By turning the lever 20 that is in the engaging state, the ribbon winding spool 21 can be turned as much as the lever 20.

Also, on the back side of the ribbon frame 10, a ribbon wind motor 55 is provided for rotating the ribbon winding spool 21. As shown in FIG. 9, a decelerating gear 54 is provided on the shaft 49 of the ribbon winding spool 21 so as to mesh with a gear 56 of the ribbon wind motor 55 for rotation.

Since removing slack in the inked ribbon 11 is desirable upon installation, the above mentioned lever 20 can be used as a slack eliminating means in the marking press device 1. In other words, when the ribbon winding spool 21 is set in the ribbon frame 10, the lever 20 is turned together with the ribbon winding spool 21 to remove slack in the inked ribbon 11. After eliminating the slack, the lever 20 is pulled up and turned to activate the ribbon winding spool 21 as described above.

Figure 8:
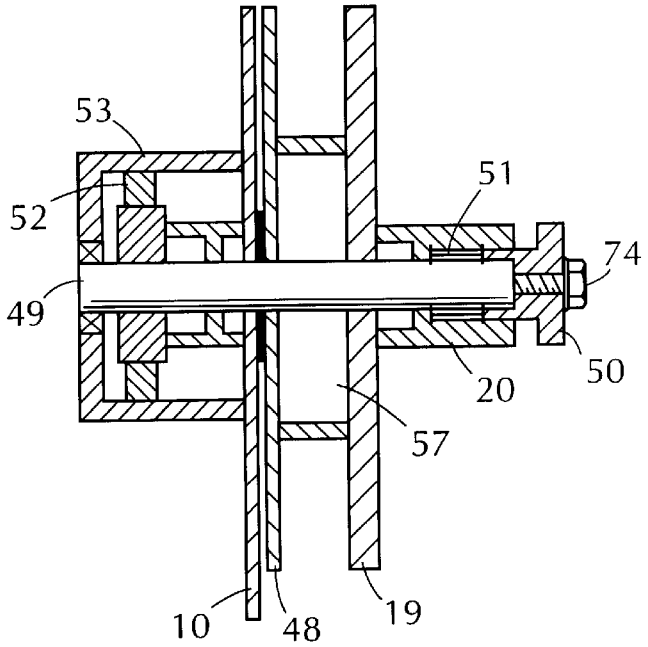
FIG. 8 is a vertical cross-sectional view of a structure of a ribbon supplying spool, seen from the side.

As shown in FIG. 8, the ribbon supplying spool 57 has basically the same configuration with the ribbon winding spool 21. They are arranged at symmetrical positions as shown in FIG. 7. Note that, as shown in FIG. 8, the ribbon supplying spool 57 is not connected to a motor and the like, but freely rotates so as to feed the inked ribbon 11 with sufficient tension.

Then, a spring 52 is provided inside a friction boss 53 on the back side of the ribbon frame 10 and also the ribbon supplying spool 57 idles when an excessive torque is exerted so that the inked ribbon 11 is always given a predetermined tension, not an excessive tension. When slack occurs in the inked ribbon 11, the spring 52 rotates the shaft 49 to eliminate the slack in the inked ribbon 11.

To prevent slack in the inked ribbon 11, it is preferred that a friction is applied to the ribbon supplying spool 57 if necessary so that the inked ribbon 11 is given a predetermined tension, preventing the excessive rotation. It is further preferred that slack be actively removed using back tension and friction mechanism.

Next, a configuration for guiding the inked ribbon 11 from the ribbon supplying spool 57 to the ribbon winding spool 21 will be described. The supplied inked ribbon 11 is guided by a guide roller 58 and a ribbon guide 59 on the supply side, to pass the ribbon guiding route 14, and then guided to the ribbon winding spool 21 by a ribbon guide 59 and a guide roller 58 on the winding side.

In this embodiment, as shown in the figure, ribbon arms 15, 15 are symmetrically arranged respectively on the supply side and the winding side. Ribbon guides 59, 59 are attached to ends of the ribbon arms to make the height of each of the ribbon guides 59, 59 variable so that the height of the ribbon guiding route 14 can be changed. In this case, the positions of ribbon arm fulcrums 17, centers of the swing of the ribbon arms 15, are not specified. However, it is preferred that the length of the entire route of the ribbon 11 remains the same even when the ribbon arms 15 oscillate. In this embodiment, then, the ribbon arm fulcrums 17 are positioned as shown in FIG. 7 so that the route length of the ribbon 11 barely changes even when the ribbon arms 15 oscillate.

Figure 2:
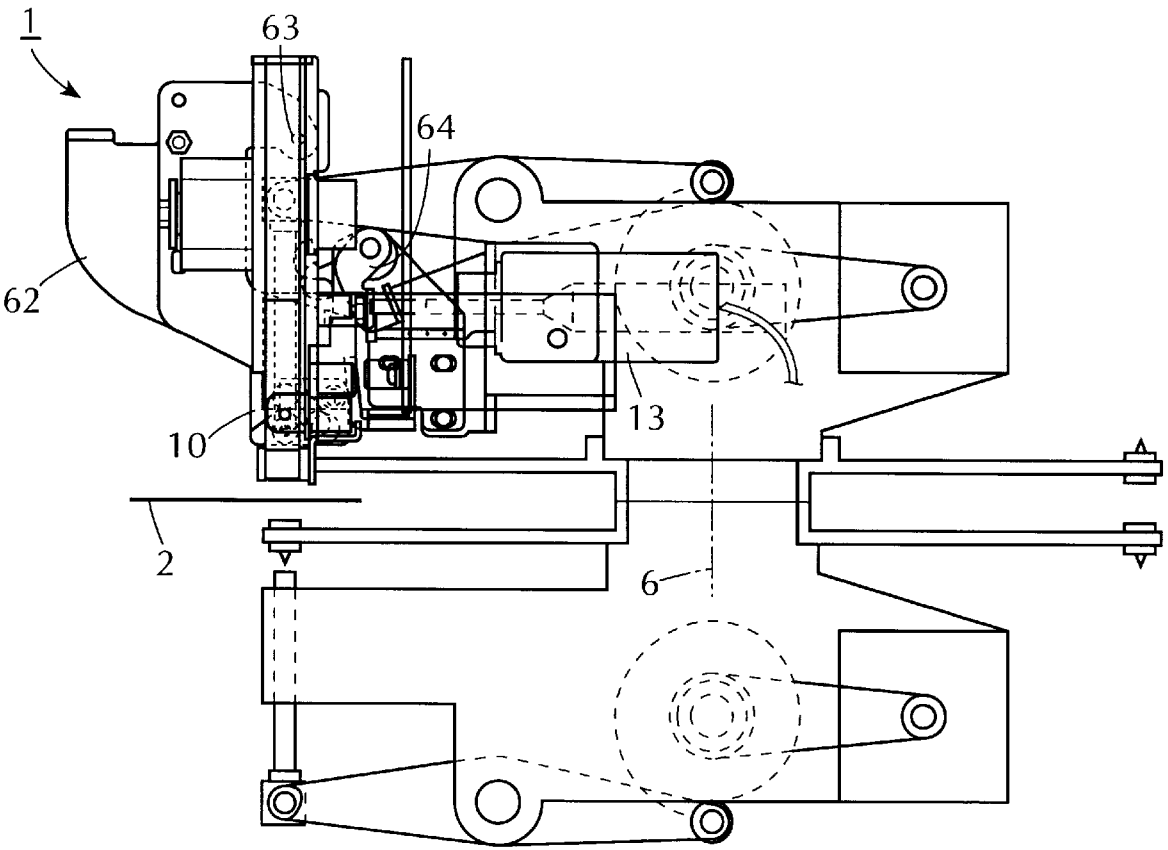
FIG. 2 is a side view of the marking press device with the ribbon frame in a perpendicular position.
Figure 3:
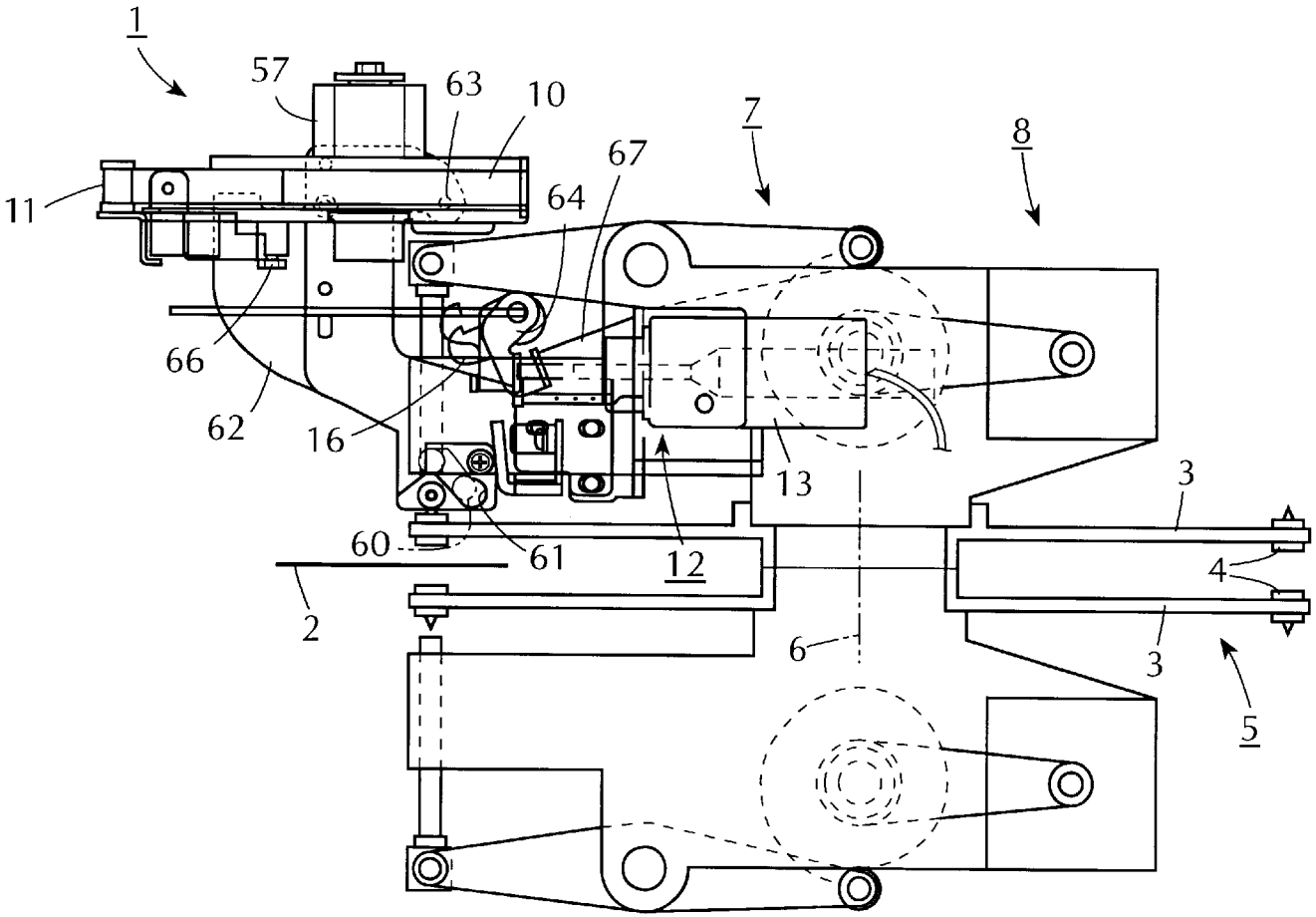
FIG. 3 is a side view of the marking press device with the ribbon frame in a horizontal position.

Another roller 60 is provided on the other end of the ribbon arm 15. Further, a cam 61 that guides the roller 60 is provided on a ribbon frame supporting plate 62, as shown in FIG. 3. The cam 61 is formed diagonally facing the upper front of the marking press device 1. Therefore, the roller 60 is positioned the lowest and far back when the ribbon frame 10 is at the stand-by position shown in FIG. 1. On the other hand, the roller 60 is guided upwardly by the cam 61 when the ribbon frame 10 is at the back indent position as shown in FIG. 2. At this time, the ribbon arm 15 oscillates following the movement of the roller 60, and the ribbon guide 59 located opposite the roller 60 moves in the reverse direction of the movement of the roller 60. Accordingly, the ribbon guide 59 is raised when the ribbon frame 10 is at the stand-by position, and lowered when the ribbon frame 10 at the back indent position. With this configuration, the inked ribbon 11 is on the ribbon guiding route 14 indicated by a phantom line in FIG. 7 when the ribbon frame 10 is at the stand-by position. When the ribbon frame 10 moves to the back indent position, the inked ribbon 11 is lowered for insertion under the workpiece 2 while moving forward. Consequently when an indented character needs to be colored, the position of the ribbon guiding route 14 is changed to let the inked ribbon 11 be inserted between the workpiece 2 and the type 4.

Next a ribbon frame turning mechanism 12 will be described. The ribbon frame 10 is rotatably mounted about the fulcrum 63 on the ribbon frame supporting plate 62, as shown in FIG. 1 through FIG. 3, so that the ribbon guiding route 14 can be moved to be between the workpiece 2 and the type 4 when the indented character on the workpiece 2 needs to be colored. In this embodiment, the turning center on the ribbon frame 10 is positioned on the slightly back side as shown in FIG. 1 so that the ribbon frame 10 stays inclined when receiving no force. Note that an energizing means such as a coil spring or a cam may be used to constantly energize the ribbon frame 10 toward the back, in addition to using the self-weight of the frame to return the ribbon frame 10 to the stand-by position.

The ribbon frame 10 is capable of turning forward at least to a horizontal state, as shown in FIG. 3, when receiving no force. The marking press device 1 is equipped with the ribbon frame 10, to which the ribbon supplying spool 57, ribbon winding spool 21, and ribbon guiding mechanism 9 are mounted, and the ribbon frame rolling means, which rotatably supports the ribbon frame 10 and turns the ribbon frame 10 to the horizontal state above the type arm 3 (in the figure) when the inked ribbon 11 is replaced. Thus, when the inked ribbon 11 is replaced, the ribbon frame 10 is turned by hand to the horizontal position. This improves visual confirmation and operability during the replacement. When the inked ribbon 11 is supplied in the marking press device 1, the ribbon winding spool 21 and ribbon supplying spool 57 may be replaced while the frame 10 is horizontally positioned. This simplifies the operation. Also, the inked ribbon 11 can be set to the ribbon guide 59 with certainty. At that time, it is desirable to keep the ribbon frame 10 in the horizontal state as shown in FIG. 3 for an easier operation. In this embodiment, a stopper (not clearly illustrated) is provided to secure the ribbon frame 10. The stopper engages with the ribbon frame 10 in the horizontal position to keep the horizontal condition and the engagement thereof can be removed manually. Although, in this embodiment, the spool is replaced when the ribbon frame 10 is at the horizontal state, it is not limited to this, but any positions may be taken as long as the spool can be replaced easily.

The ribbon frame 10 is normally at the inclined state (at the stand-by position) as shown in FIG. 1. It is turned forward as shown in FIG. 2 only when the back indent is performed. The means for turning the ribbon frame is not specifically limited, but in this embodiment, the solenoid 13 which is a driving means is used to turn the ribbon frame 10. At that time, although the solenoid 13 can be used to directly project the ribbon frame 10, a swing member 64 is interposed as shown in FIG. 3 in this embodiment. The swing member 64 serves to turn the ribbon frame 10 by swinging upon the movement of the tip end of a plunger of the solenoid 13 and then by pushing the back surface of the ribbon frame 10 outwardly. An energizing spring 67 is provided on the swing member 64 as shown in FIG. 3 to constantly energize the swing member 64 toward the back.

The ribbon frame 10 is required to precisely insert the ribbon guiding route 14 between the workpiece 2 and the type 4 on the lower side for the back indent. Therefore, it is preferred to position the ribbon frame 10 in a perpendicular state as shown in FIG. 2 as accurately as possible. For this reason, this embodiment provides a key-shaped stopper 16 for controlling the position of the ribbon frame 10 for the back indent. The stopper 16 has a catching nail on the upper side as shown in FIG. 3, and is provided integrally with the swing member 64 so as to swing together. As shown in FIG. 7, a through hole that engages with the stopper 16 is provided on the ribbon frame 10 side.

Since the stopper 16 is lowered for the most of the operation, as shown in FIG. 3, the nail of the stopper 16 is not being caught in the through hole 65. In this way, the stopper gives no controls or restrictions to the ribbon frame 10. Accordingly, the ribbon frame 10 can freely be turned by hand from the stand-by position shown in FIG. 1 to the horizontal position shown in FIG. 3.

On the other hand, when the solenoid 13 is used to turn the ribbon frame 10 forward, the stopper 16 is engaged to control the movement of the ribbon frame 10. Therefore, the ribbon frame 10 stops turning at the perpendicular position as shown in FIG. 2. In other words, when the solenoid 13 is excited with the ribbon frame at the stand-by position shown in FIG. 1, the plunger of the solenoid 13 extends to turn the ribbon frame 10 forwardly via the swing member 64. At the same time, the stopper 16 swings, rises in the through hole 65, and catches the ribbon frame 10 with the nail. Thus, the solenoid 13 is used to turn the ribbon frame 10 and to actuate the stopper 16 so that the ribbon frame 10 can be stopped at the predetermined perpendicular position (the back indent position).

Note that, although the position of the ribbon frame 10 is determined by the stopper 16 as described above, other methods may be employed for positioning the ribbon frame. For example, the stopper 16 may be used only when the ribbon frame 10 is turned too far, and the ribbon frame 10 may basically be set to a predetermined position by engaging the solenoid 13 or cam. Note that, when the position of the ribbon frame 10 is determined by the solenoid 13 or cam, it is desirable that a fine adjustment can be performed on the position of the ribbon frame. In this embodiment, a stop position adjusting screw 66 is provided as shown in FIG. 3. By turning the screw 66, the stop position of the ribbon frame 10 can precisely be adjusted.

It is needless to say that, in the marking press device 1 in which the ribbon frame 10 can be turned until it comes to the horizontal position, the stopper 16 is provided to control the movement of the ribbon frame 10, but not to hinder it. In the marking press device 1, when the ribbon frame 10 is turned by hand, the stopper 16 always passes through the through hole 65, but never hits the periphery of the hole 65.

Figure 6:
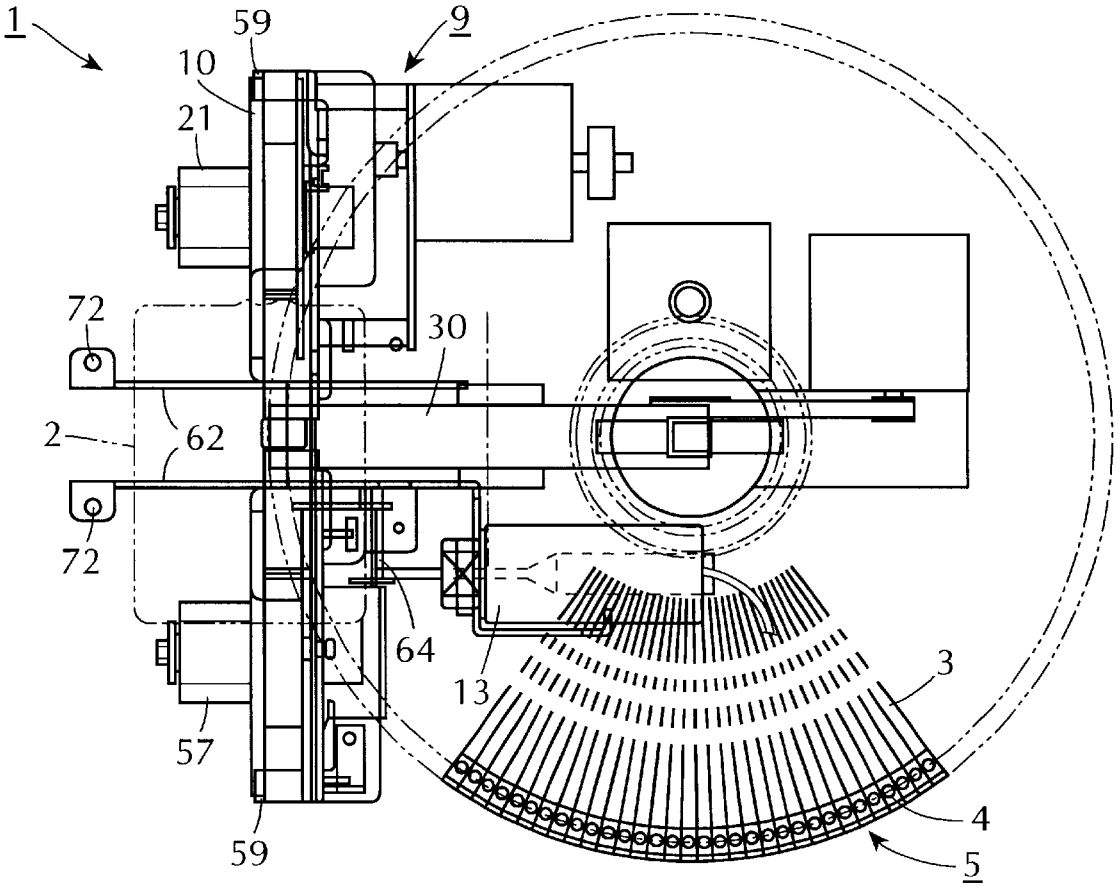
FIG. 6 is a plan view of the marking press device of FIG. 2.

Also, it is preferred that the ribbon frame 10 is equipped with a fixing means so as to be fixed to the ribbon frame supporting plate 62 if necessary. In this embodiment, as shown in FIG. 6 and FIG. 7, screw holes 72 are provided at the tip ends of the ribbon frame supporting plates 62, and screw holes 73 corresponding to the screw holes 72 are provided on the ribbon frame 10.

Accordingly, the ribbon frame 10 can be attached to the ribbon frame supporting plates 62 with the screws so that it is not displaced when the marking press device 1 is transported. Further, another hole (not shown in the figures in particular) may be provided to fix the ribbon frame at the stand-by position shown in FIG. 1. When only a unit for producing indented characters and embossed characters is transported, the ribbon frame is fixed at the position shown in FIG. 1 so that the entire size of the unit does not become too large. When the entire marking press device 1 is transported as a card issuing machine, the ribbon frame may be fixed at the horizontal position shown in FIG. 3. Thus, the fixing condition can be selected according to what form of the device is transported.

The operation of the marking press device 1 will be described hereinafter. Note that the marking press device 1 is commonly used for producing both embossed characters and indented characters (including front indent and back indent), and therefore, an appropriate process of producing embossed characters or indented characters can be selected accordingly.

First, when the process for producing embossed characters on the front surface of the workpiece 2 is only performed, supposing that coloring is not required, it is necessary to withdraw the inked ribbon 11 from the position of the types 4. For this, the ribbon frame 10 is not turned, and the inked ribbon 11 stays at the stand-by position as shown in FIG. 1. The type arm driving motor 23 is driven to rotate the type assembling member 5 so that a target type 4 is selected. At the same time, the workpiece 2 is moved by the transporting mechanism 47 to align the character position with the selected the type 4. Also, the cam driving motors 35, 45 respectively located at top and bottom are actuated to rotate the cams 33, 43 so that the swing arms 30, 40 respectively at top and bottom swing about the fulcrums 31, 41 to push up the type pressing shafts 27, 37 via the pressing blocks 29, 39, and then the types 4, 4 are pressed onto the workpiece 2 from top and bottom to make a mark.

Next described is the case to produce indented characters while coloring the grooves of the characters with the inked ribbon 11. Here, to interpose the inked ribbon 11 between the workpiece 2 and the type 4 on the bottom side in the figure for coloring, the ribbon frame 10 is turned to move the ribbon guiding route 14. In this case, as described above, the solenoid 13 is excited to turn the ribbon frame 10 via the swing member 64. During the turning, the stopper 16 works control the movement of the ribbon frame 10 so that the ribbon frame is held at the perpendicular position shown in FIG. 2.

As the ribbon frame 10 is turned, the roller 60 rolls up the slope of the cam 61 to swing the ribbon arm 15 so that the ribbon guiding route 14 is lowered. Consequently, the inked ribbon 11 is lowered while moving forward, changing from the stand-by position shown in FIG. 1 to the position shown in FIG. 2 at which the back indent can be performed. Note that, in the marking press device 1, the ribbon frame 10 is turned prior to transporting the workpiece 2 to the pressing position, and the ribbon guiding route 14 is first changed and then the workpiece 2 is moved.

When the inked ribbon 11 is replaced, the ribbon frame 10 is turned by hand to the horizontal position, and then engaged with the stopper (not in the figure) to be fixed in the horizontal position as shown in FIG. 3. Then, as the lever 20 is turned to disengage the ribbon frame from the stopper, the ribbon winding spool 21 and ribbon supplying spool 57 are easily dismounted. When the inked ribbon is replaced, the solenoid 13 is not excited. Therefore, the stopper 16 does not move, and therefore, the movement of the ribbon frame 10 is not restricted so that it can turn to the horizontal position.

Note that, although the above embodiment is an example of preferred embodiments of the present invention, the embodiment is not limited to this, but can variously be modified within the scope the present invention. Although the above embodiment was described with the back indent for which the inked ribbon 11 is interposed between the workpiece 2 and the type 4 on the lower side, the pressing form is not limited to this. In other words, for the front indent, the inked ribbon 11 is interposed between the front surface of the workpiece 2 and the type 4 on the upper side. Thus, the configuration of the marking press device can appropriately be modified to change the moving length (width) of the ribbon guiding route 14. Further, the present invention can be employed not only for coloring during the indented character production, but also for coloring during the embossed character production.

In this embodiment, the roller 50 that rolls up the cam 61 is used to swing the ribbon arm 15, but the means for swinging the ribbon arm is not limited to this. For example, one end of a wire which is adhered to the ribbon frame supporting plate 62 with the other end thereof may be tied around the ribbon arm 15 so that, when the ribbon frame 10 is turned, the wire may pull the ribbon arm 15 to swing it. Moreover, the ribbon arms 15, 15 on right and left may be connected by a link so that, when one of the ribbon arms 15 swings, the other ribbon arm 15 may swing simultaneously.

An embodiment of a marking press device applied to form Braille code characters will be described in detail.

Note that a basic configuration of the marking press device is the same as the above described embodiment. Therefore, the same codes are used and the description thereof is omitted, but a configuration of the device for forming Braille characters and the operation thereof are described. For example, supposing that this embodiment is applied in the marking press device 1 shown in FIG. 4 and FIG. 5, the marking press device 1 is configured to form Braille code characters onto a workpiece (card) 2. In the marking press device 1, a type 40 (corresponding to the code 4 in FIGS. 4 and 5) has at least six pairs of Braille character type sets 90, . . . , 90, each of the pair consisting of raised-dot cell 100 and recessed-dot cell 110. Each of the raised-dot cells 100, . . . , 100 has a raised dot 100*a* that corresponds to one of six points used for forming Braille dot patterns. Each of the recessed-dot cells 110,. . . , 100 has six recesses 100*a*, . . . , 100*a* that correspond to six points used for forming Braille dot patterns. A plurality of type sets 90 necessary for forming Braille code characters are repeatedly pressed in a predetermined location on the workpiece 2.

Figure 10:
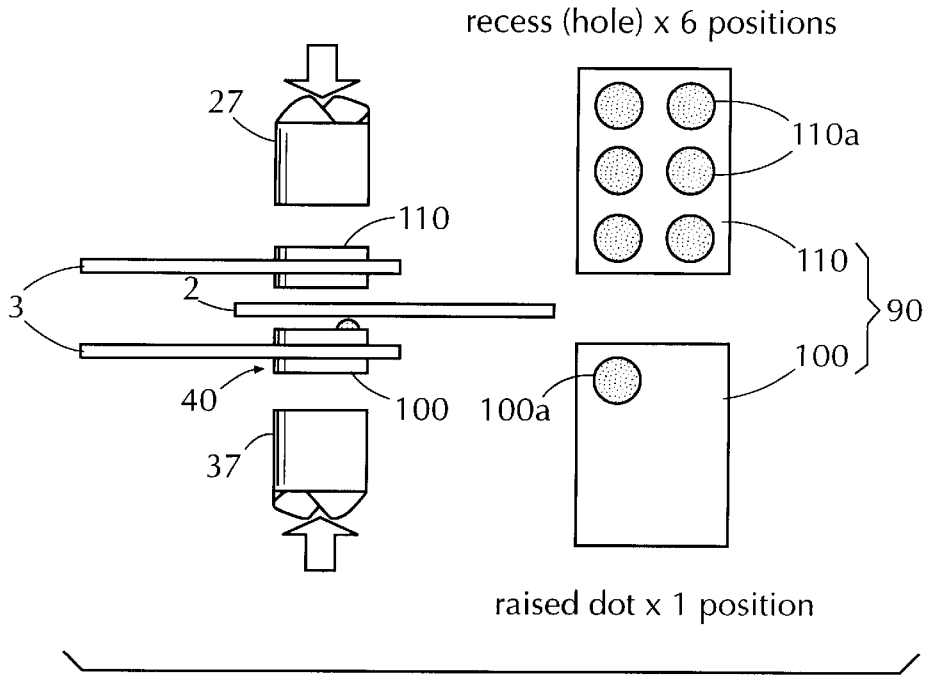
FIG. 10 is a partial view of a type periphery of the marking press device showing an embodiment of the present invention and pressing faces of a Braille character type set.

Next, the configuration of the marking press device 1 for forming Braille code characters is described. As illustrated in FIG. 10, Braille character type set 90 of the marking press device 1 is composed of raised-dot cell 100 positioned below the workpiece 2 and recessed-dot cell 110 positioned above the workpiece 2. The raised-dot cell 100 and recessed-dot cell 110 are positioned at the tip end portions of the type arms 3, in the same manner as the aforementioned type 4, to be interposed between the upper type pressing shaft 27 and lower type pressing shaft 37. In this case, the raised-dot cell 100 and recessed-dot cell 110 can be placed in gaps between the types 4 arranged in the circumferential direction on the type arms 3. The raised-dot cell 100 and recessed type 110 constitute a pair of Braille character type set 90. In this embodiment, six pairs of Braille character type sets 90 are prepared.

The raised-dot cell 100 has a raised dot 100*a* that protrudes upwardly as illustrated in FIG. 10. In this case, the raised dot 100*a* is positioned corresponding to only one of the six dots for Braille code character. For example, the first Braille character type set 90 shown in FIG. 11 has the raised-dot cell 100 with a raised dot 100*a* positioned on the upper left in the figure.

In the same manner, the remaining five pairs of Braille character type sets 90 respectively have only one raised dot 100*a* in the raised-dot cell 100. However, raised dot 100*a* is in a different dot position in each set, thus providing six kinds of raised-dot cells 100 for total. Note that, in this embodiment shown in FIG. 11, since the raised-dot cell 100 used for the first type set 90 is symmetric with the raised-dot cell 100 used for the sixth type set 90, identical cells may be prepared and one of them be inverted by 180 and mounted on the type arm 3. The same applies to the second and fifth type sets and to the third and fourth type sets.

Figure 11:
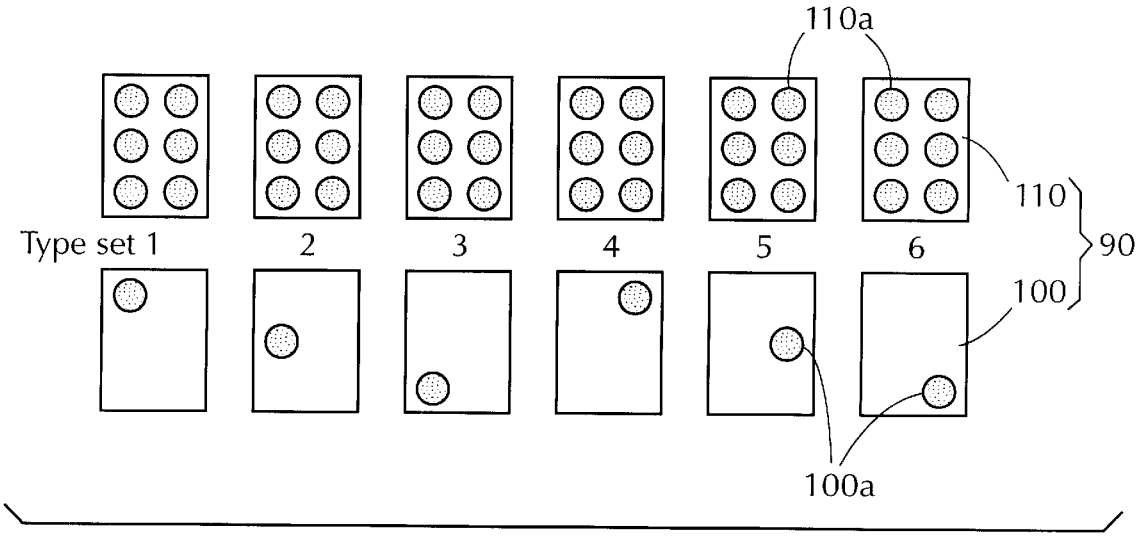
FIG. 11 illustrates six kinds of Braille character type sets, each of which has a different type pattern.

On the other hand, as illustrated in FIG. 10 and FIG. 11, the recessed-dot cell 100 has six recesses 100*a*, . . . , 100*a* at positions according to the Braille code system. Therefore, the recessed-dot cells 110, . . . . , 100 in the marking press device 1 employ the same recess arrangement for each Braille character type set 90. Twelve cells used in six pairs of Braille character type sets 90, . . . , 90 are composed of only four kinds of cells.

In this case, the recess 110*a* is properly provided according to the size of the Braille character that varies depending on the material of workpiece 2. It is preferred that the inner diameter of the recess 110*a* be determined in the size, within which the dot already formed on the workpiece 2 can be fitted, because the workpiece 2 should be guided to a place suitable for the embossing.

Note that, in this embodiment, the six pairs of Braille character type sets 90, . . . , 90 are arranged in the type assembling member 5 of the marking press device 1 illustrated in FIG. 4 and FIG. 5, that is normally used for embossing. With this, the marking press device 1 is capable of forming Braille code characters as well as a normal embossing.

The operation of forming Braille characters with the above mentioned Braille character type set 90 will be described. Note that a plastic card is used as the workpiece 2 in the description below.

Figure 12:
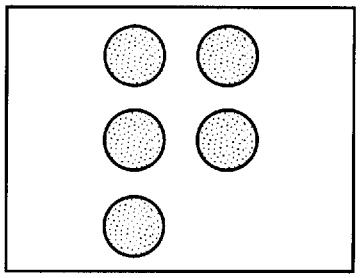
FIG. 12 is a Braille dot pattern having the meaning of "Te" (phonetic spelling of a katakana)
Figure 13:
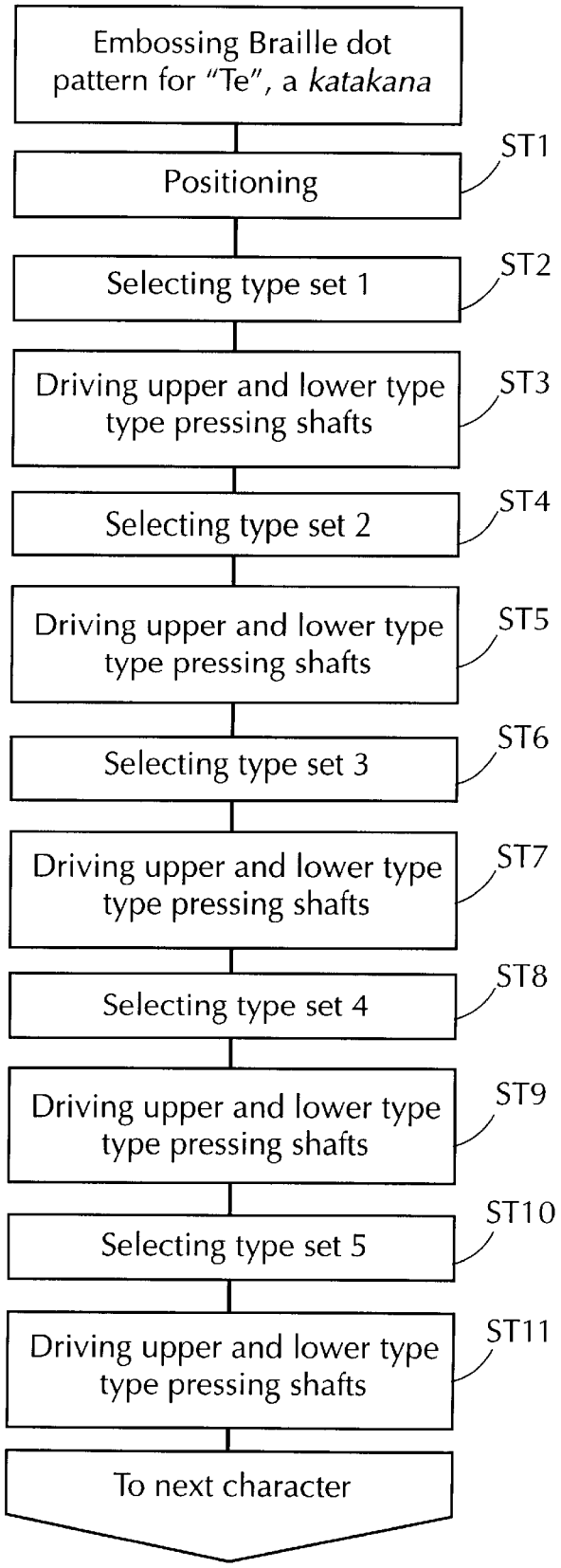
FIG. 13 is a flowchart of a Braille code character formation.

This embodiment is of forming Braille code character "Te" (phonetic spelling for a katakana) that is composed of five dots as shown in FIG. 12. First, as shown in FIG. 13, the workpiece (card) 2 is positioned by the card transporting mechanism 47 (Step 1). Next, the type arms 3 are driven to select the first Braille character type set shown in FIG. 11 and position it between the type pressing shafts 27, 37 (Step 2).

Then, the upper cam driving motor 35 and lower cam driving motor 45 are driven to actuate the pressing means 7 so that the card 2 together with Braille character type sets 90 are inserted between the upper type pressing shaft 27 and the lower type pressing shaft 37 (Step 3). With this, the first dot of the Braille dot pattern for "Te" (phonetic spelling for a katakana) is embossed in a predetermined position on the workpiece (card) 2.

Next, the second type set shown in FIG. 11 is selected (Step 4), and the type pressing shafts 27, 37 are driven to emboss the second dot (Step 5). The already embossed first dot is fitted in one of the recesses 110*a* on the recessed-dot cell 110. Therefore, the second dot can be embossed without pressing down the first embossed dot. In addition, the first dot is guided to a predetermined position by the inner wall of the recess 100*a* when the second dot is embossed so that the workpiece (card) 2 is also aligned with a predetermined position. Therefore, the recesses 100*a* can serve as a means for positioning the workpiece (card) 2 as well as a means for protecting dots that are already formed on the workpiece.

The same steps are carried out for the third through the fifth type sets to emboss five dots in a predetermined pattern on the workpiece (card) 2. Thus, the Braille dot pattern for "Te" (phonetic spelling for a katakana) is formed (Step 6 through Step 11). After one Braille code character is formed in this manner, the workpiece (card) 2 is shifted by a predetermined amount for the next character.

According to the above mentioned marking press device 1, in addition to marking and pressing selected characters on the workpiece (card) 2 with the types 4, Braille code characters can be formed by the Braille character type sets 90, . . . , 90. Moreover, since the marking press device 1 is equipped with six recessed-dot cells 100, . . . , 110, already formed dots are protected in pressings of successive dots. Therefore, it is possible for the marking press device 1 to form all the Braille code characters with only six pairs of Braille character type sets 90, . . . , 90, contributing to a simple configuration and saving the space for Braille code character formation.

Also, the recesses 110*a* serve as a guide for dots so that a workpiece (card) 2 can be precisely positioned for the next dot embossing. Therefore, according to the marking press device 1, although one Braille dot pattern is formed in several pressings of dots, a perfect Braille dot pattern can be formed as if it were produced by one time strike.

Figure 14:
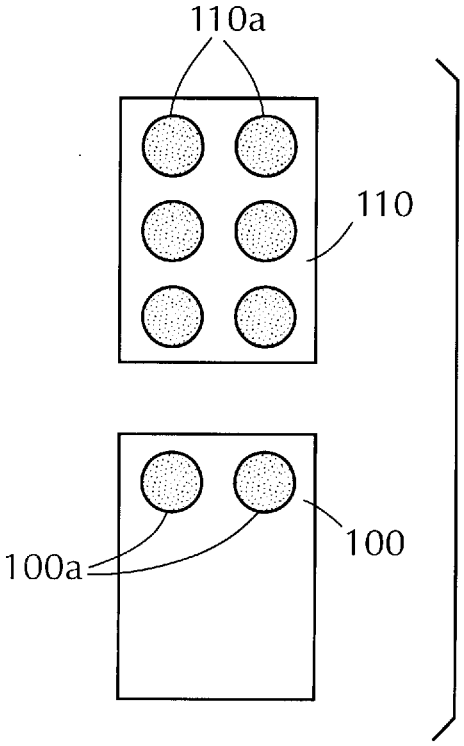
FIG. 14 shows an example of a Braille character type set having a different pattern of raised dots.
Figure 15:
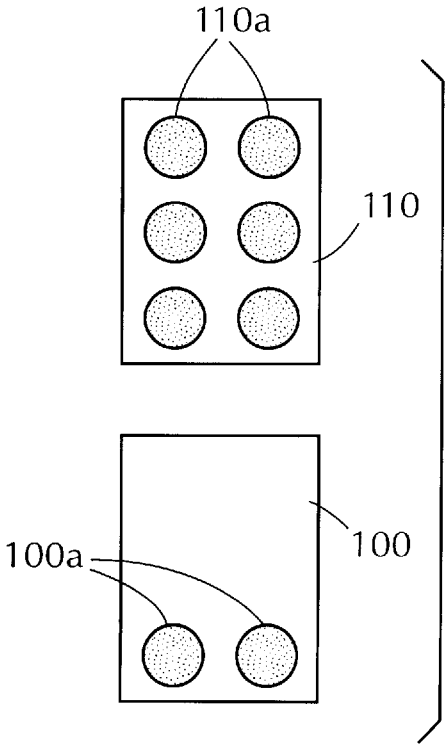
FIG. 15 shows another example of a Braille character type set having a different pattern of raised dots.

Note that, although the embodiment applied for Braille code character formation is one of the preferred embodiments of the present invention, it is not limited to this, but can variously be modified within the scope of the invention. For example, although six kinds of raised-dot cells 100, . . . , 100 respectively having a raised dot 110*a* as shown in FIG. 11 are employed in the above embodiment, raised-dot cells 100, that are employed for embossing frequently used Braille dot patterns, and a recessed-dot cell having six recesses 110*a*, . . . , 100*a* may be made in a plurality of pairs and retained in the device in addition to the six primary pairs. In other words, the frequently used raised dots 100*a* for forming Braille dot patterns are combined as shown in FIG. 14 to construct a raised-dot cell 100 having two raised dots. Or, if raised dots 100*a*, 100*a* respectively positioned at bottom are frequently used, a raised-dot cell 100 having two raised dots 100*a*, 100*a* at bottom may be constructed as shown in FIG. 15.

In the above mentioned embodiment, a plastic card is used as the workpiece 2 on which characters, Braille dot patterns, etc. are pressed. However, a workpiece, a subject to be marked and pressed, is not particularly limited to this. According to the marking press device 1 configured as above, marking and pressing can be performed on metallic material or paper materials, as well as plastic cards.

While the present invention has been particularly shown and described in conjunction with preferred embodiments thereof, it will be readily appreciated by those of ordinary skill in the art that various changes may be made without departing from the spirit and scope of the invention.

Therefore, it is intended that the appended claims be interpreted as including the embodiments described herein, the alternatives mentioned above, and all equivalents thereto.

What is claimed is:

1. A marking press device, comprising:

a pair of type arms that face each other to interpose a workpiece to be marked therebetween;

a type fixed on each of said type arms for making a mark thereof;

a circular type assembling member around which a plurality of said type arms are attached radially;

pressing means for rotatably supporting said type assembling member around a rotary shaft and for pressing a selected type from said type assembling member onto said workpiece;

driving means for rotating said type assembling member;

a ribbon guiding mechanism that guides an inked ribbon for coloring marked characters;

a ribbon supplying spool for supplying said inked ribbon;

a ribbon winding spool for winding said inked ribbon;

a ribbon frame to which said ribbon guiding mechanism, said ribbon supplying spool and said ribbon winding spool are mounted; and ribbon frame turning means for rotatably supporting said ribbon frame and turning said ribbon frame to a horizontal position above said type arms when said inked ribbon is replaced.

2. The marking press device as set forth in claim 1 wherein, for embossing, said ribbon frame is positioned such that said inked ribbon is withdrawn from a typing position on a front side of said workpiece.

3. The marking press device as set forth in claim 1 wherein said ribbon frame is turned by hand when said inked ribbon is replaced.

4. The marking press device as set forth in claim 1 wherein, for indenting said ribbon frame is turned to a position at which said inked ribbon is inserted between said type and said workpiece.

5. The marking press device as set forth in claim 1 wherein, when said inked ribbon is set in said ribbon frame, a ribbon winding flange mounting lever is turned to rotate said ribbon winding spool so that slack in said inked ribbon is eliminated.

6. The marking press device as set forth in claim 1 wherein said pressing means consists of type pressing shafts, swing arms, cams, and cam followers.

7. A marking press device, comprising:

a pair of type arms that face each other to interpose a workpiece to be marked therebetween;

a type fixed on each of said type arms for making a mark thereof;

a circular type assembling member around which a plurality of said type arms are attached radially;

pressing means for rotatably supporting said type assembling member around a rotary shaft and for pressing a selected type from said type assembling member onto said workpiece;

driving means for rotating said type assembling member;

a ribbon guiding mechanism that guides an inked ribbon for coloring produced characters;

a ribbon supplying spool for supplying said inked ribbon;

a ribbon winding spool for winding said inked ribbon;

a ribbon frame to which said ribbon guiding mechanism, said ribbon supplying spool and said ribbon winding spool are mounted; and ribbon frame turning means for rotatably supporting said ribbon frame, said ribbon frame turning means moving said ribbon frame between a position, at which said inked ribbon is withdrawn from a typing position on said workpiece, and a position, at which said inked ribbon is inserted between said type and said workpiece.

8. The marking press device as set forth in claim 7 wherein said inked ribbon is interposed between said type and a back surface of said workpiece for coloring marked characters at a back indent.

9. The marking press device as set forth in claim 8 wherein said workpiece is positioned inside said ribbon guiding route.

10. The marking press device as set forth in claim 7 wherein said ribbon frame is turned by a driving means.

11. The marking press device as set forth in claim 7 further comprising ribbon arms that move following the movement of said ribbon frame and lower said ribbon guiding route with respect to said workpiece to color a marked character.

12. The marking press device as set forth in claim 11 wherein ribbon arm fulcrums are provided at positions with which the length of said ribbon route varies only slightly as said ribbon arms oscillate up and down.

13. The marking press device as set forth in claim 7 wherein a stopper is provided for controlling the position of said ribbon frame that is turned by a driving means to color a marked character.

14. The marking press device as set forth in claim 13 wherein, when said ribbon frame is turned by hand, said stopper is not engaged.

15. The marking press device as set forth in claim 7 wherein said pressing means includes type pressing shafts, swing arms, cams, and cam followers.

16. A marking press device comprising:

first and second opposing circular type wheels having a plurality of opposing type arms that face each other to interpose a workpiece to be marked therebetween, each pair of the opposing type arms including at least one type for making a mark on the work piece;

a press that presses a selected type from the first and second type wheels onto the work piece;

a driver that rotates the first and second type wheels;

ribbon frame including a ribbon guiding mechanism that guides an inked ribbon for coloring marked characters; and a ribbon frame turning mechanism that turns the ribbon frame to a replacement position for replacing the inked ribbon.

17. The marking press device according to claim 16 wherein the ribbon frame turning mechanism is further operable to rotably support the ribbon frame and the replacement position is a horizontal position above the type arms.

18. The marking press device according to claim 16 wherein the ribbon frame turning mechanism is further operable to move the inked ribbon of the ribbon frame to a coloring position between a selected pair of the opposing type arms and a non-position coloring position away from the selected pair.

* * * * *